US005533632A

United States Patent [19]

Patterson et al.

[11] Patent Number: 5,533,632

[45] Date of Patent: Jul. 9, 1996

[54] MOTORIZED ACCESSORY HOLDER AND METHOD OF USING SAME

[75] Inventors: Liliana M. Patterson, 4031 W. Lakeshore Dr., San Ramon, Calif. 94583; Kenneth A. Tarlow, Corte Madera, Calif.

[73] Assignee: Liliana M. Patterson, San Ramon, Calif.

[21] Appl. No.: 294,900

[22] Filed: Aug. 23, 1994

[51] Int. Cl.[6] ..... A47F 3/08; A47F 3/11; A47F 5/025; A47F 5/02

[52] U.S. Cl. ..... 211/122; 211/1.57; 211/77; 211/115; 211/162; 198/681; 198/678.1

[58] Field of Search ..... 211/122, 115, 211/77, 1.57, 162; 198/681, 678.1, 679; D6/315, 322; D7/590

[56] References Cited

U.S. PATENT DOCUMENTS

| | | | |
|---|---|---|---|
| D. 229,909 | 1/1974 | Goldfeder | D6/117 |
| 237,645 | 2/1881 | Waldron | 198/681 |
| D. 298,591 | 11/1988 | Arner et al. | D6/315 |
| D. 352,177 | 11/1994 | Nadel | D6/315 |
| D. 355,770 | 2/1995 | Tayler et al. | D6/315 |
| 4,742,924 | 5/1988 | Tarlow et al. | 211/60.1 |

*Primary Examiner*—Leslie A. Braun
*Assistant Examiner*—Brian J. Hamilla
*Attorney, Agent, or Firm*—Townsend and Townsend and Crew

[57] ABSTRACT

A motorized accessory holder (12) includes a body (4) having a lower region defining a circumferential track (14). A belt assembly (6), including a continuous loop belt (28) and support arms (34) extending outwardly from the belt, is housed within the body. A drive assembly (8), used to drive the belt along a continuous loop path with the outer ends (38) of the support arms supported by the track, is also housed within the body. Different types of accessory supports (10) adapted to support different types of accessories are removably secured to and hang from the support arms. For example, the accessory supports can be configured to support neckties, earrings, necklaces, belts or even spice jars.

27 Claims, 9 Drawing Sheets

MOTORIZED ACCESSORY HOLDER AND METHOD OF USING SAME

BACKGROUND OF THE INVENTION

Organizing the storage of ties, scarves, belts and other personal accessories has been and remains a problem. Closet space always seems to be in short supply so that it is not practical to use a great deal of closet space to store such personal accessories. One solution has been the use of a motorized article supporting device, typically used to support neckties. See, for example, U.S. Pat. No. 4,742,924 to Tarlow and Arner. Such accessory holders can be useful in storing a number of ties one behind the other and then moving them along a continuous oval path to bring them in view and make them accessible. However, they are typically only suited for neckties or something similar to neckties, such as scarves.

SUMMARY OF THE INVENTION

The present invention is directed to a motorized accessory holder which is designed to be used with interchangeable accessory supports which can be removably secured to and hang from support arms of the unit to allow the unit to be customized to fit one's personal needs, such as through the use of belt hooks, jewelry pouches, tie holders and scarf holders.

The motorized accessory holder includes a body having a lower region defining a circumferential track. A belt assembly, including a continuous loop belt and support arms extending outwardly from the belt, is housed within the body. A drive assembly is used to drive the belt along a continuous loop path. The outer ends of the support arms are supported by the track. A plurality of accessory supports are removably secured to and hang from the support arms. The accessory supports are adapted to support one or more types of accessories. For example, the accessory supports can be configured to support neckties, earrings, necklaces, belts or even spice jars.

A primary advantage of the invention is its flexibility. It can be customized according to what and in what numerical proportions various personal items are to be stored. For example, one user might use it primarily for neckties and belts while another might have a mixture of neckties, belts, scarves, and jewelry pouches.

An important feature of the invention is that the support arms are not cantilevered; rather, they are supported at their inner ends by the belt and at their outer ends by the track. This permits the belt and support arms to be made of thinner, lighter material than would be possible with conventional cantilevered arms. This helps to reduce the weight and size of the accessory holder, thus reducing its cost.

The invention will likely find its greatest utility as a holder for various personal accessories which would be convenient to be stored in one's closet. The invention is also applicable to storing other types of items, such as containers holding spices. In this case, the accessory supports could be modified to hold different sizes of cylindrical and rectangular containers to accommodate the different sizes and types of containers which herbs and spices are packaged in.

Other features and advantages of the invention will appear from the following description in which the preferred embodiment has been set forth in detail in conjunction with the accompanying drawings.

DESCRIPTION OF THE PREFERRED EMBODIMENT

Figure 1:
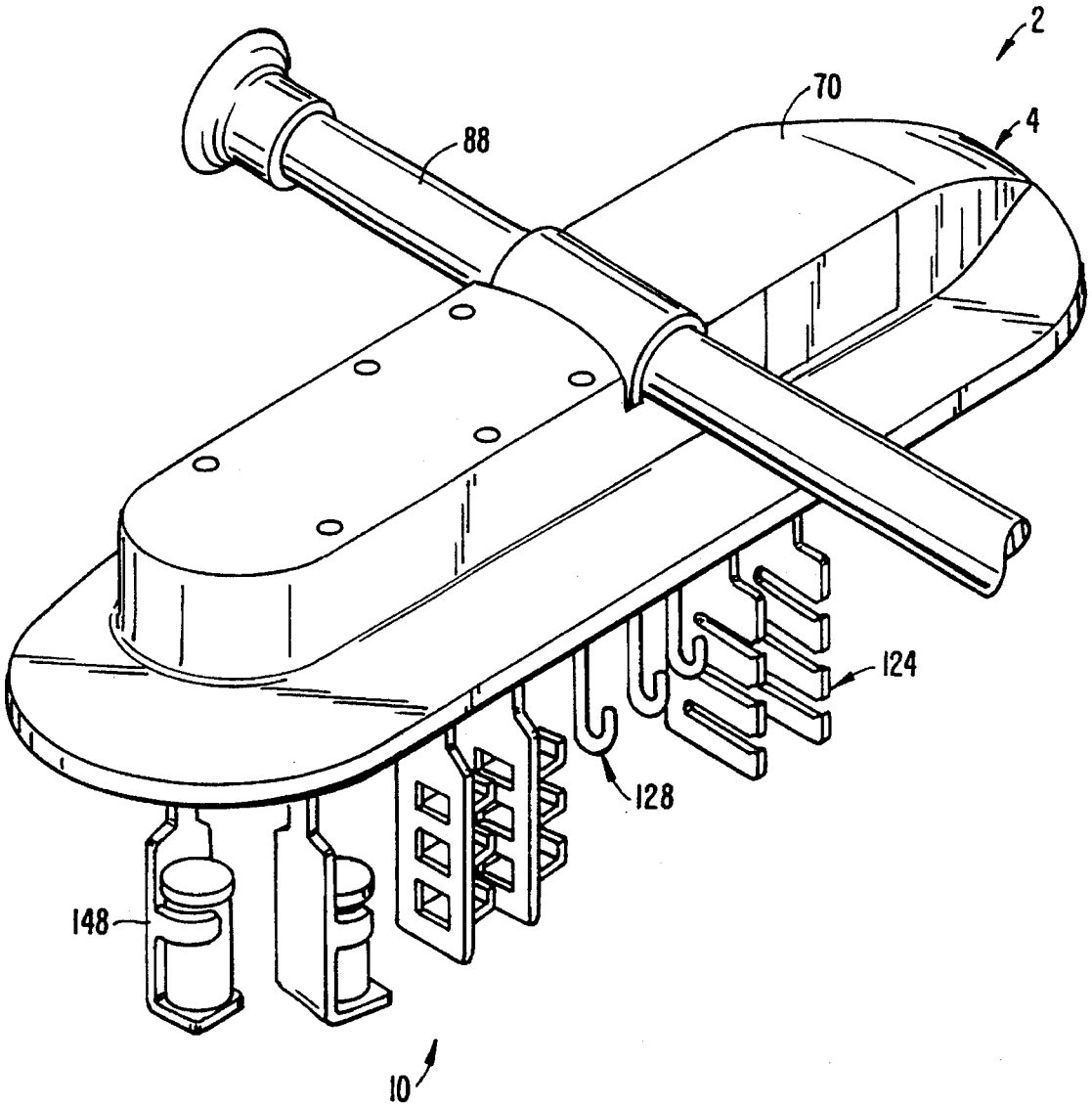
FIG. 1 is an overall view of a motorized accessory holder made according to the invention.
Figure 2:
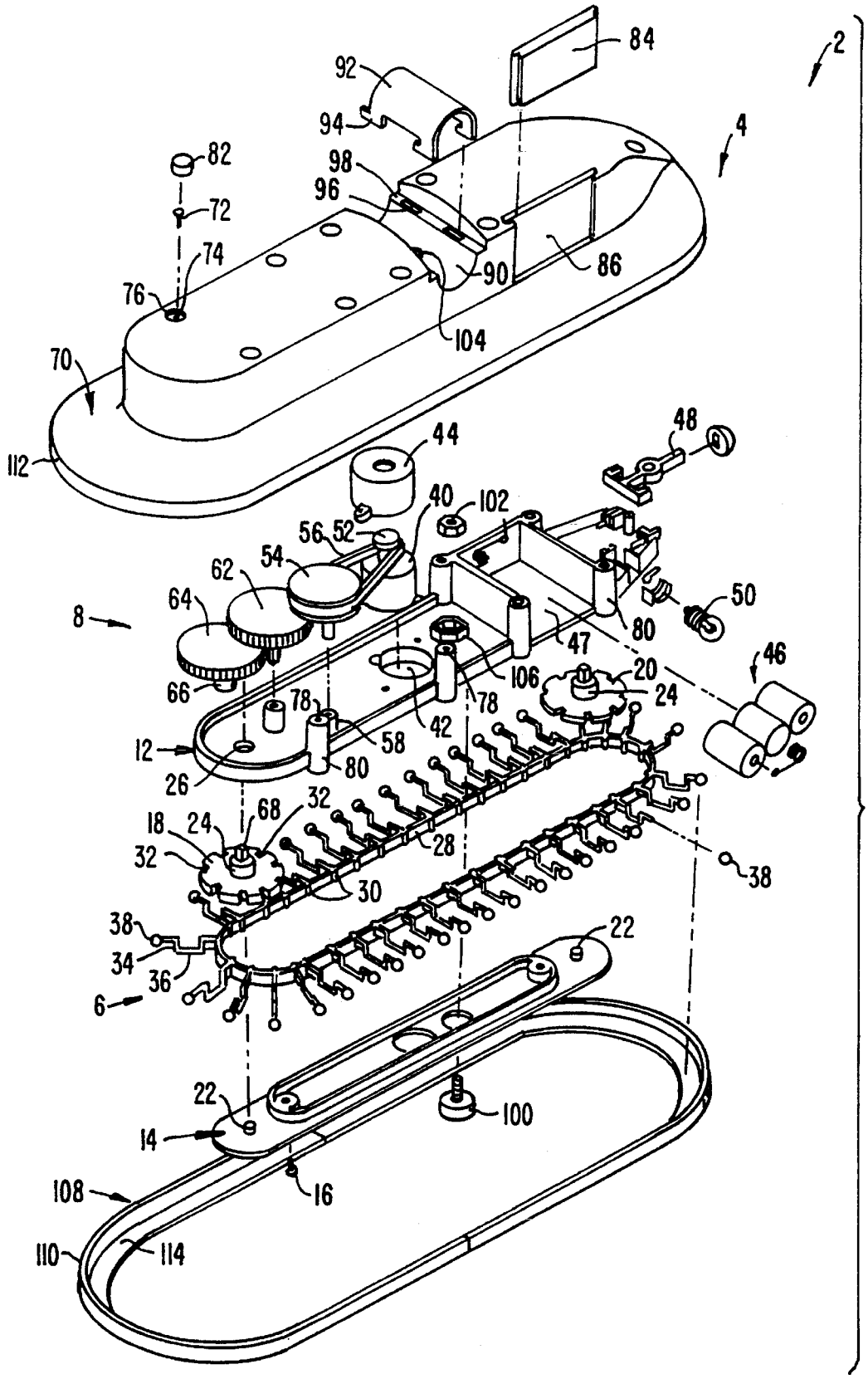
FIG. 2 is an exploded isometric view of the accessory holder of FIG. 1 but without any of the accessory supports of FIG. 1.
Figure 2A:
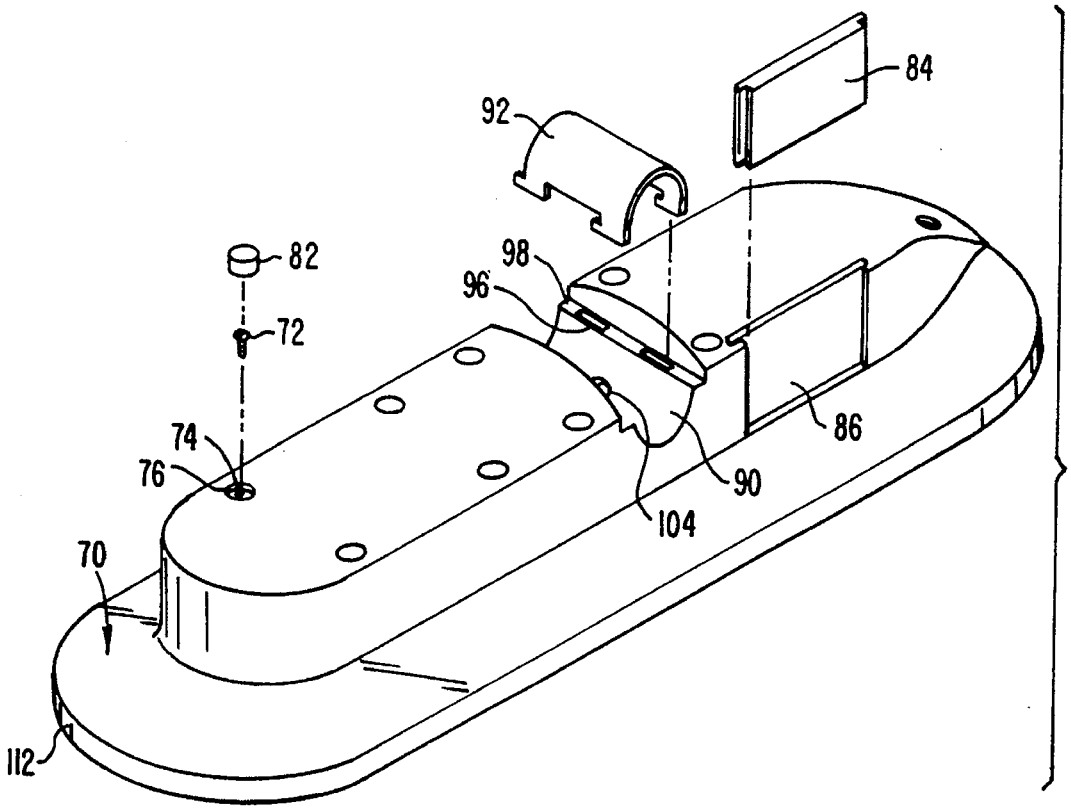
FIGS. 2A–2C are enlarged views of different sets of the components illustrated in FIG. 2.
Figure 2B:
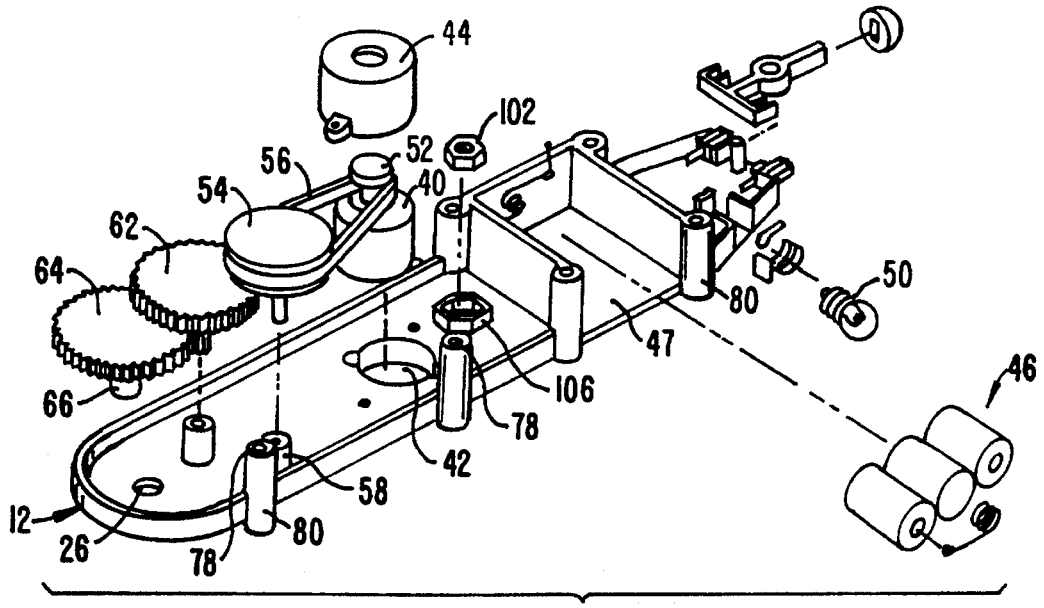
Figure 2C:
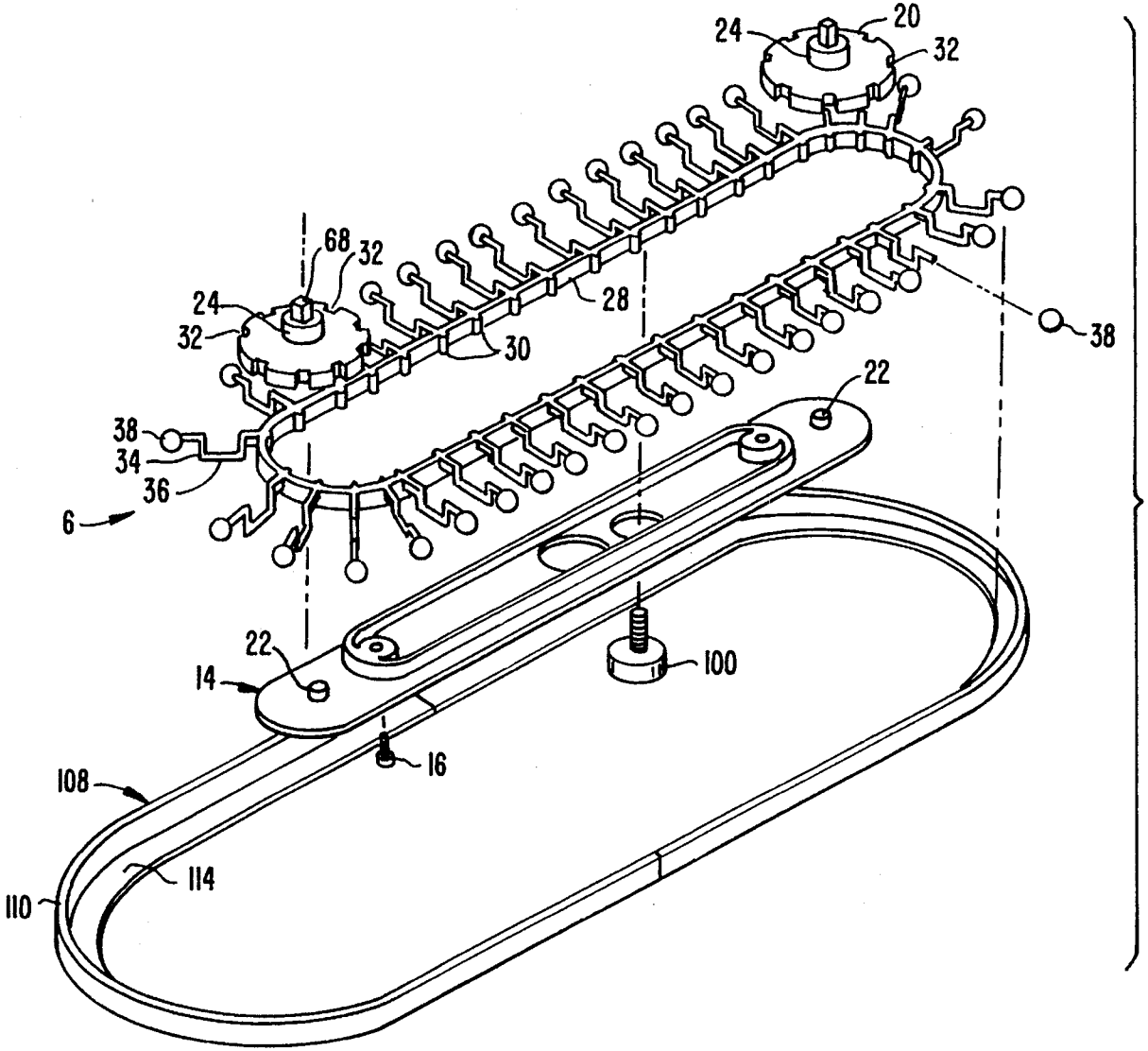
Figure 4:
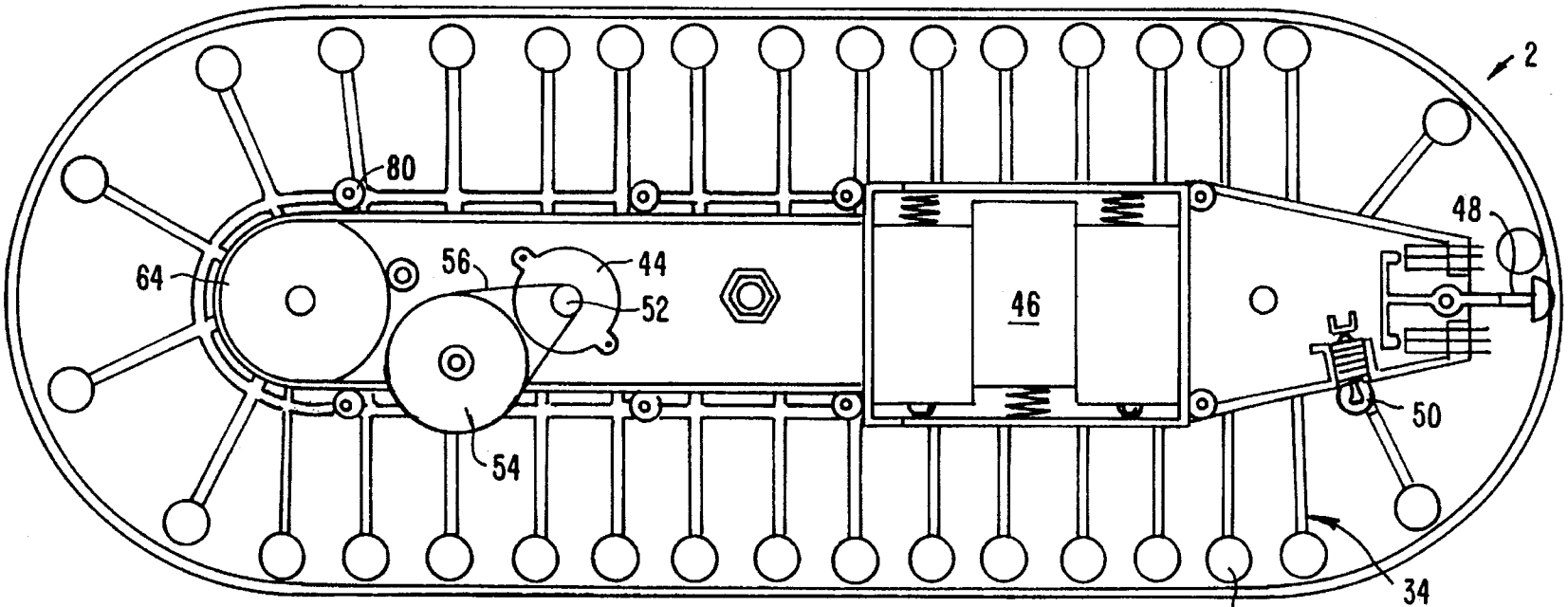
FIG. 4 is a top plan view of the assembly of FIG. 1 with the cover removed.

FIGS. 1 and 2 illustrate a motorized accessory holder 2 including broadly a body 4, housing a belt assembly 6 which is driven by a drive assembly 8, and a plurality of replaceable accessory supports 10 supported by the belt assembly.

Body 4 includes a base 12 and a sprocket support 14, sprocket support 14 being secured to the underside of base 12 by screws 16, only one being shown in FIG. 2. A drive sprocket 18 and an idler sprocket 20 are captured between base 12 and sprocket support 14 through the engagement of a short spindle 22 engaging a complementary opening, not shown, formed in sprockets 18, 20 and a spindle 24 engaging a complementary opening 26 formed in base 12. Sprockets 18, 20 are used to guide and drive belt assembly 6.

Belt assembly 6 includes a continuous loop belt 28 having numerous lugs 30 formed along its inner surface. Lugs 30 are sized and positioned to engage notches 32 formed in drive and idler sprockets 18, 20. Belt assembly 6 also includes outwardly extending, generally U-shaped support arms 34. Support arms 34 each have a bight 36 centrally along its length and a support ball 38 at the distal end of the support arm 34.

Base 12 and sprocket support 14 are preferably made of styrene and sprockets are preferably made of acetyl. Belt 28 and support arms 34 are preferably made as a one-piece molded part of polypropylene. Balls 38 are made of a suitable low friction material, such as polypropylene, and can be spherical as illustrated or some other shape to reduce manufacturing costs and/or increase manufacturing speed. Other suitable materials can also be used.

Drive assembly 8 is generally supported by base 12 and includes, in addition to drive and idler sprockets 18, 20, a motor 40 mounted at position 42 by a motor housing 44. Motor 40 is a 6 volt D.C. motor such as made by Mabuchi Corp. of Japan. Motor 40 is powered by a set of batteries 46, housed in a battery compartment 47 in base 12, under the control of a toggle switch 48. Toggle switch 48 is a three-position switch. Switch 48 controls not only motor 40 but also a light bulb 50. Moving switch 48 in one direction from a central, off position will operate motor 40, driving belt assembly 6 in one direction, and illuminate light bulb 50; moving switch 48 in the opposite direction will cause motor 40 to drive belt assembly 6 in the opposite direction and also illuminate light bulb 50. Light bulb 50 helps illuminate the end of accessory holder 2 at which the user is making his or her selection.

Figure 3:
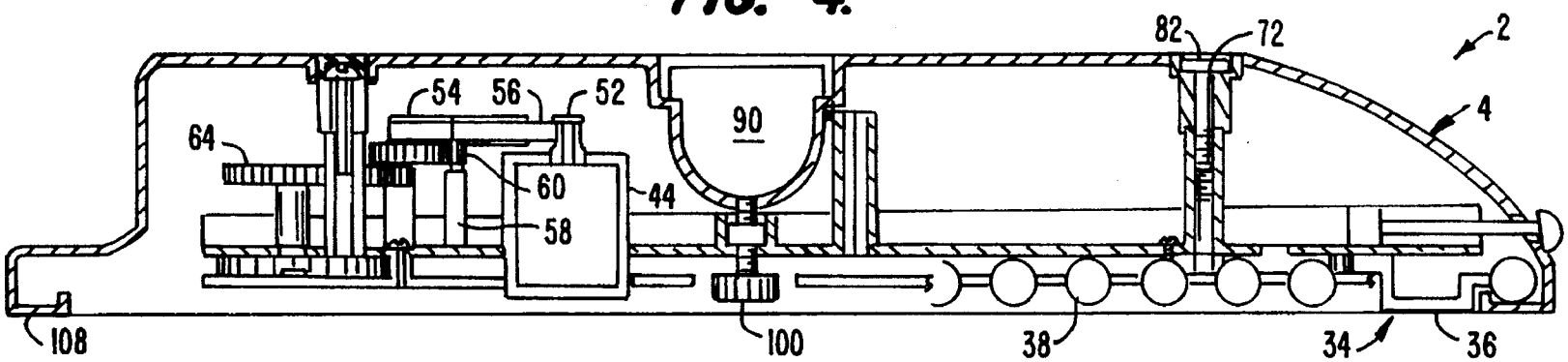
FIG. 3 is a longitudinal cross-sectional view of the assembly of FIG. 1.

Motor 40 drives speed reduction pulley 52, which is coupled to a second speed reduction pulley 54 through a belt 56. Pulley 54 is supported by a hollow support 58 extending from base 12 and has an integrally formed pinion 60 situated just below pulley 54. See FIG. 3. Pinion 60 drives a pair of speed reduction gears 62, 64, gear 64 including a hollow shaft 66 having a hollow interior configured to mate with the rectangular tip 68 of spindle 24 to complete the drive train from motor 40 through drive sprocket 18. Pulleys 52, 54, pinion 60 and gears 62, 64 are preferably made from acetal or nylon.

Body 4 also includes a cover 70, preferably made of styrene, which covers base 12 and various components therein. Base 12 is secured to cover 70 by eight screws 72, only one of which is shown in FIG. 2. The screws pass through holes 74 formed within countersunk regions 76 formed in cover 70 and are threaded into holes 78 formed at the upper ends of standoffs 80. Standoffs 80 are integral extensions of base 12. The heads of screws 72 are covered by friction fit screw caps 82. Screw caps 82 have an aesthetic function and also help to ensure that screws 72 do not loosen during use.

Cover 70 includes a battery access cover 84 which can be slid upwardly to expose an access opening 86 positioned opposite battery compartment 47.

Accessory holder 2 is designed to be suspended from a bar 88 as shown in FIG. 1. Bar 88 is captured within a U-shaped recess 90 formed in cover 70. A bar clip 92 having L-shaped feet 94 is used to secure bar 88 to cover 70 with feet 94 engaged within appropriately sized and positioned slots 96 formed in a ledge 98 adjacent recess 90 in cover 70. Bar 88 is kept from moving within recess 90 by the use of a thumbscrew 100. Thumbscrew 100 passes through a threaded nut 102 and a hole 104 formed in the bottom of recess 90 so to press against bar 88. Nut 102 is kept from rotating by being housed within a hexagonal enclosure 106 formed as a part of base 12.

Body 4 also includes a track member 108 having an outer, upwardly extending lip 110 which engages a downwardly extending lip 112 of cover 70. Track member 108, typically made of styrene, and base 12 are secured to each other, such as through the use of an adhesive or using ultrasonic welding techniques. This engagement could also be through a snap fit arrangement as well. Track member 108 defines a circumferentially extending track 114 upon which support balls 38 are supported and slide.

A primary advantage of the invention is that it is intended to be used with removable and replaceable accessory supports 10 designed to hold or support different types of accessories. FIGS. 5–10 illustrate six different types of accessory supports 10, some designed for specific use and some designed for more general use.

Figure 5A:
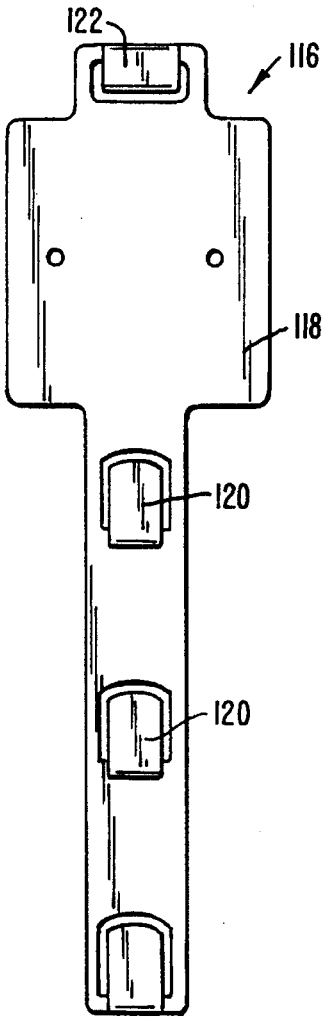
FIGS. 5A and 5B are front and side elevational views of a three-hook accessory support.
Figure 5B:
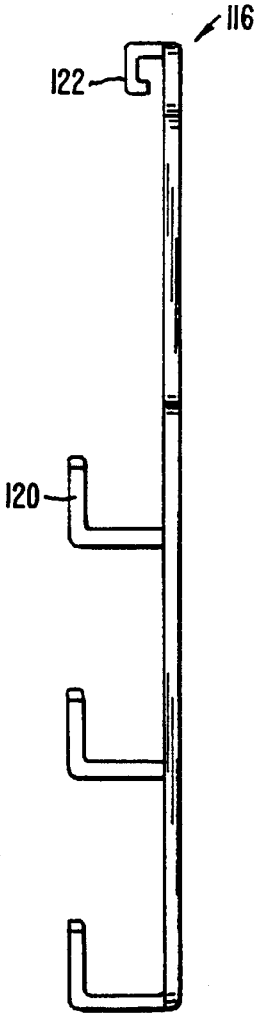
Figure 6A:
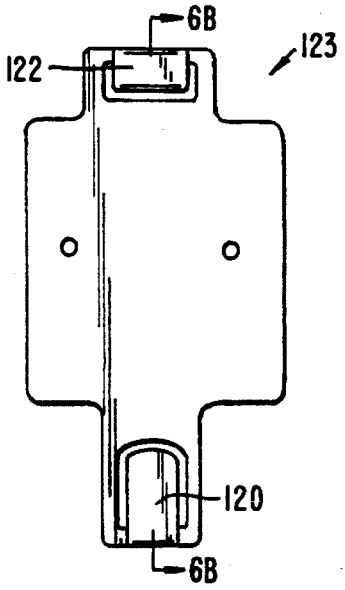
FIGS. 6A and 6B are front and side cross-sectional views of a single hook accessory support, FIG. 6B taken along line 6B—6B of FIG. 6A.
Figure 6B:
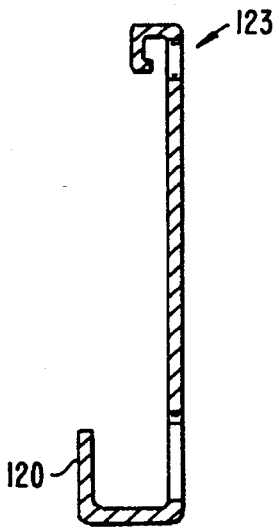

FIGS. 5A and 5B illustrate a three-hook accessory support 116 having a planar body 118 from which three hooks 120 are formed. At the upper end of body 118 is an inverted generally U-shaped hook or clip 122 sized to snap onto bight 36 of support arm 34 to enable accessory support 116 to be removable and replaceable onto support arms 34 but to prevent accessory support 116 from being inadvertently dislodged from the support arms. Hooks 120 can be used to support various types of items, such as belts, scarves or jewelry. Hooks 120 could be of different sizes and could extend from both sides of body 118. FIGS. 6A and 6B show a single hook accessory support 123, similar to three-hook accessory support 116, including a U-shaped hook or clip 122 and a single hook 120.

Figure 7A:
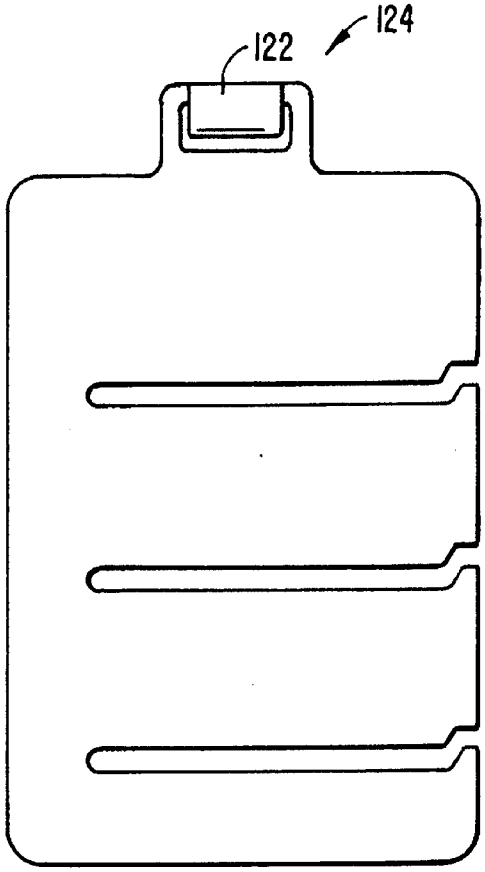
FIGS. 7A and 7B are front and side elevational views of a tie hook accessory support.
Figure 7B:
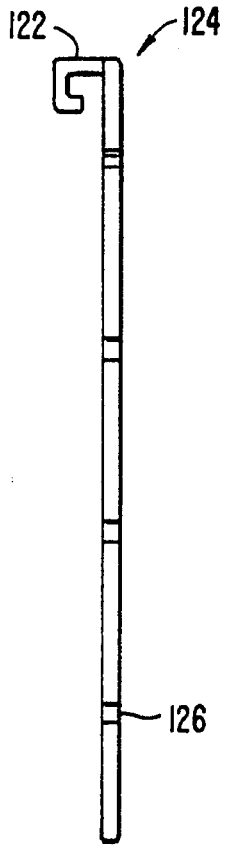
Figure 8A:
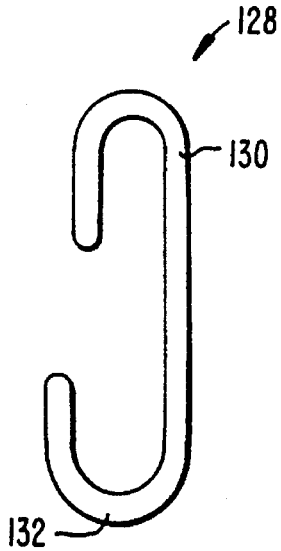
FIGS. 8A and 8B are side and rear elevational views of a C-hook accessory support.
Figure 8B:
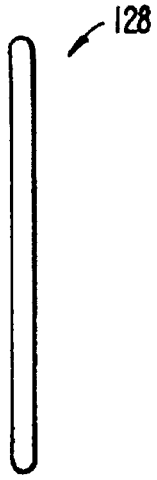

FIGS. 7A and 7B illustrate a tie hook accessory support 124 having three generally horizontally disposed slots 126 and a U-shaped hook or clip 122 at its upper end. Slots 126 are sized to support neck ties, scarves and similar accessories. Slots 126 could be of the same or different sizes. FIGS. 8A and 8B show a C-hook accessory support 128 having an inverted U-shaped upper end 130 sized to engage bight 36 and a U-shaped lower end 132 used to support various items. One or more of accessory supports 128 could be supported by a single support arm 34. Accessory supports 116, 123 are preferably made of polypropylene while accessory support 128 can be made of styrene.

Figure 9A:
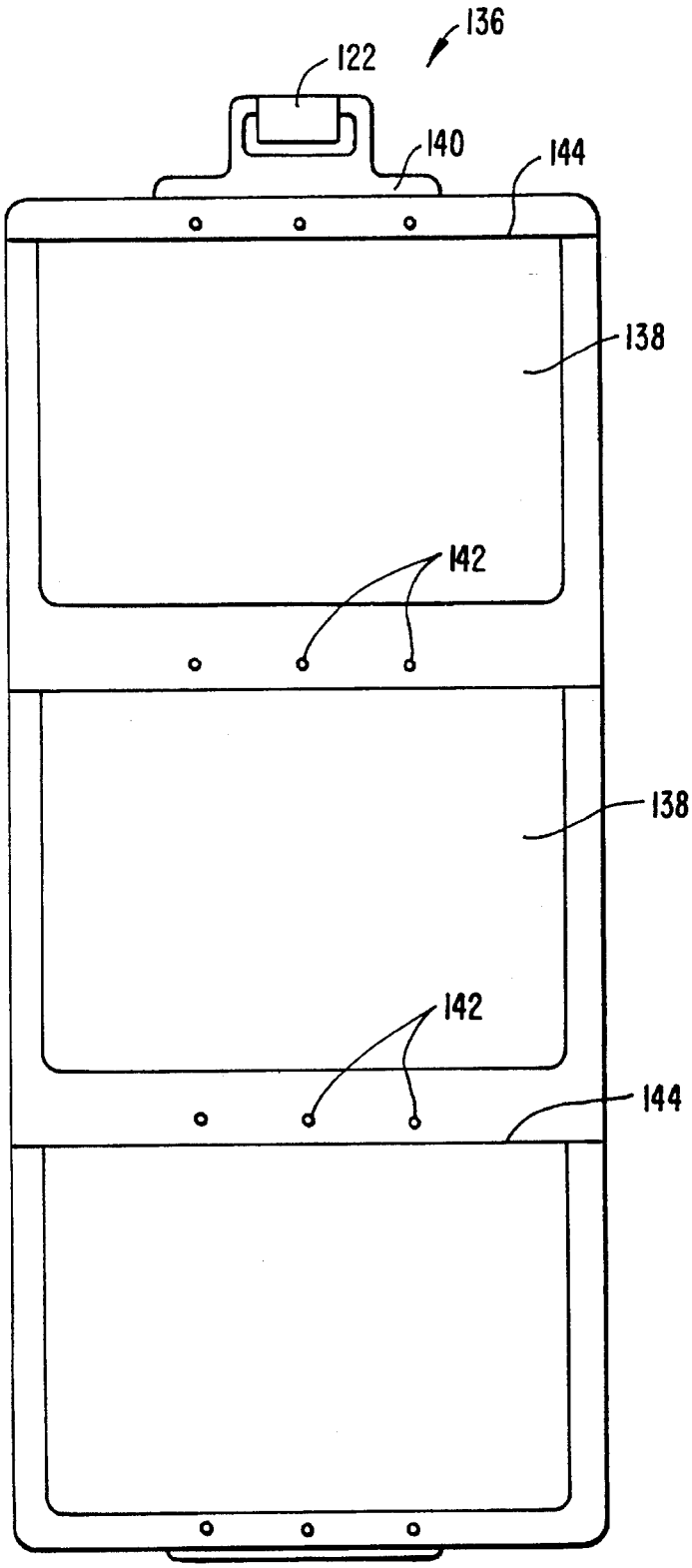
FIGS. 9A and 9B are front and side elevational views of a pocket hook accessory support.
Figure 9B:
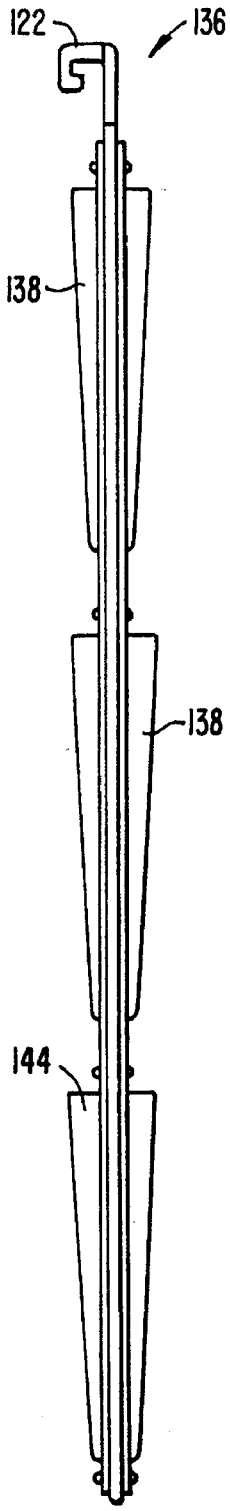

FIGS. 9A and 9B illustrate a pocket hook accessory support 136 used for supporting jewelry and other small items in a series of pockets 138 along the length of accessory support 136. Accessory support 136 includes a main, planar body 140, made of, for example, styrene, having an integral U-shaped hook or clip 122 at its upper end and a set of vinyl pockets 138 ultrasonically welded in place to body 140 at positions 142. Pockets 138 have open tops 144 to permit the small items to be placed into the pockets. The material from which pockets 138 are made is preferably clear to allow visual access to the contents of the pockets.

Figure 10A:
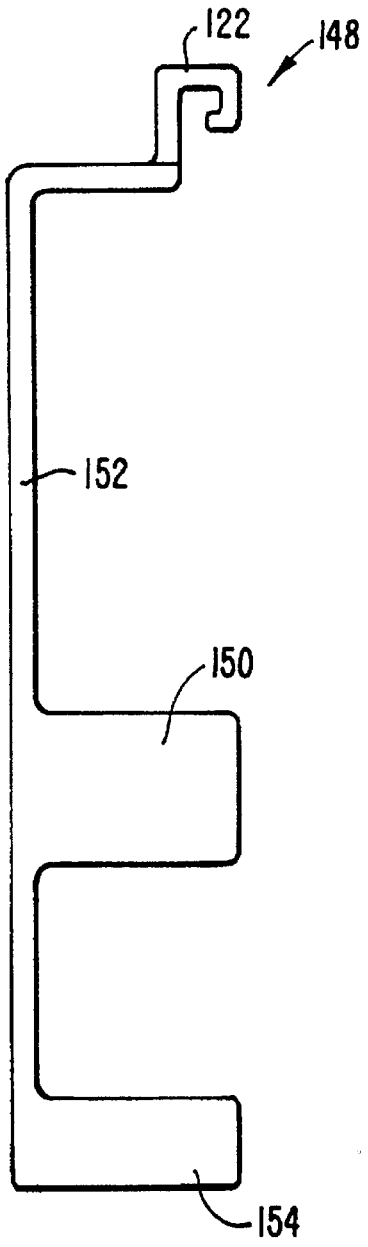
FIGS. 10A and 10B are front and side elevational views of a spice bottle hook accessory support.
Figure 10B:
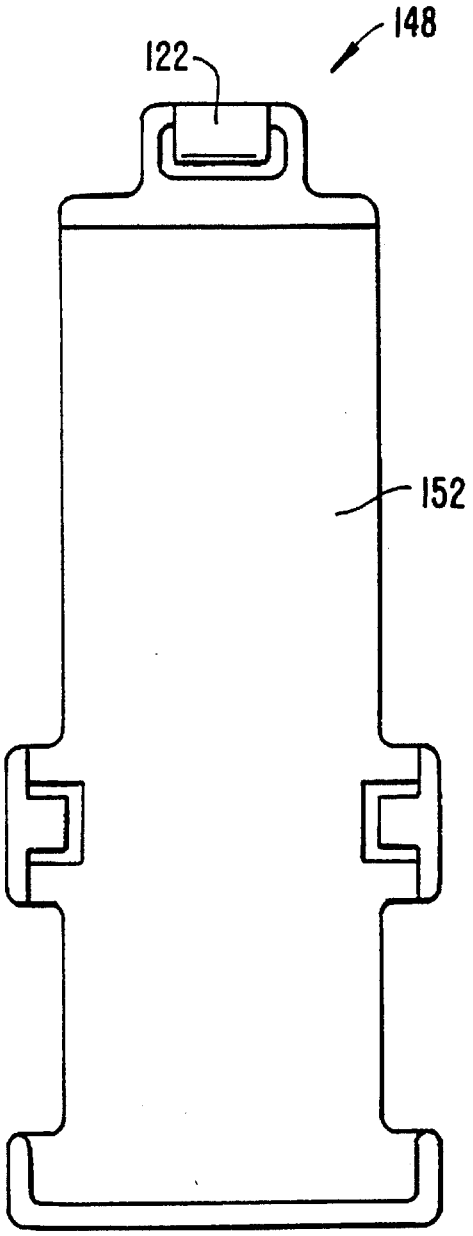

The above-described accessory supports 10 are all primarily intended for personal accessories of the type which would commonly be stored in one's bedroom. The invention could also be used for storing other types of products or accessories, such as spices. FIGS. 10A and 10B illustrate a spice bottle hook accessory support 148 including a U-shaped hook or clip 122 at its upper end, a pair of curved arms 150 positioned along and extending from the vertically extending body 152 of accessory support 148, and a support base 154 extending generally perpendicular to a lower end of body 152. Accessory support 148 is intended to support a single conventional spice bottle or similar container. The specific shape and size of assembly support 148 is determined, of course, by the size and shape of the container to be supported. A motorized accessory holder 2 could thus be used to support bottles or cans of herbs, spices or other cooking preparations within a kitchen as well as nuts, screws and other fasteners when used in, for example, a workshop.

In use, the user selects the particular number and type of accessory supports 10 to accommodate the number and type of things to be held by motorized accessory holder 2. Once this is accomplished, the desired number of accessory supports 10 of each type are mounted to bights 36 of support arms 34 and the various accessories are then attached to or placed in the appropriate accessory supports. Toggle switch is actuated to cause belt 28 to move along its endless loop path defined by sprockets 18, 20 thus bringing various items and accessories into view. If additional items need to be added to holder 2, the appropriate accessory supports 10 can be added to or removed from support arms 34 as needed.

Modification and variation can be made to the disclosed embodiment without departing from the subject of the invention as defined in the following claims. The materials from which the various parts are preferably made are merely exemplary; other materials, such as metal instead of plastic, could be used as well. Instead of batteries 46, motorized accessory holder 2 could be connected to a wall socket directly or through a transformer. Belt 28 could be assembled from several belt sections and, for example, snapped together to create continuous loop belt 28.

What is claimed is:

1. A motorized accessory holder comprising:

a body having an upper member and a lower member, the lower member defining a continously circumferential track;

a belt assembly supported by the body, the belt assembly including a continuous loop belt and support arms having inner ends supported and driven by the belt and outer ends supported by the track;

a drive assembly housed within the body, the drive assembly comprising:

an energy source;

a motor coupled to the energy source; and a drive train drivingly coupling the motor to the belt so the belt moves along an endless loop path with the outer ends of the support arms supported by the track; and accessory supports removably secured to and hanging from the support arms, the accessory supports adapted to support at least one chosen accessory therefrom.

2. The accessory holder according to claim 1 further comprising a rod clip, the rod clip and the upper member of the body configured to secure the body to a generally horizontal rod.

3. The accessory holder according to claim 2 further comprising means for immovably affixing the body to the rod.

4. The accessory holder according to claim 1 wherein the support arms are generally U-shaped.

5. The accessory holder according to claim 1 wherein the belt and support arms are made as a one-piece part.

6. The accessory holder according to claim 1 wherein the support arms include low-friction tips which engage the track.

7. The accessory holder according to claim 6 wherein the low friction tips are in the form of ball sliding elements.

8. The accessory holder according to claim 1 wherein the energy source includes a battery.

9. The accessory holder according to claim 1 wherein the drive train includes speed reduction gears and speed reduction pulleys.

10. The accessory holder according to claim 1 wherein the accessory supports include a plurality of different types of accessory supports configured to support different types of accessories.

11. The accessory holder according to claim 10 wherein the different types of accessory supports all include an inverted generally U-shaped hanger element configured to be removably secured to the support arms.

12. The accessory holder according to claim 11 wherein the support arms are generally U-shaped with the hanger elements hanging from the bights of the U-shaped support arms.

13. The accessory holder according to claim 1 wherein the accessory supports include an accessory support having a U-shaped accessory hook.

14. The accessory holder according to claim 1 wherein at least one accessory support comprises a plurality of U-shaped accessory hooks.

15. The accessory holder according to claim 14 wherein the plurality of U-shaped accessory hooks are vertically aligned.

16. The accessory holder according to claim 1 wherein the accessory supports include an accessory support having means for securing a cylindrical container thereto.

17. The accessory holder according to claim 1 wherein the accessory supports include an accessory support having a vertically extending planar support body with a least one open-top pocket supported by the planar support body.

18. The accessory holder according to claim 17 wherein said planar support body includes a plurality of said open-top pockets on opposite sides of said planar support body.

19. The accessory holder according to claim 1 wherein the accessory supports include an accessory support having a support body with an open ended, generally horizontally extending slot therein.

20. The accessory holder according to claim 19 wherein a plurality of said slots are formed in said support body, said slots sized to accept neckties as the accessory.

21. A motorized accessory holder comprising:

a body having an upper member and a lower member, the lower member defining a continuously circumferential track;

a belt assembly supported by the body, the belt assembly including a continuous loop belt and support arms having inner ends supported and driven by the belt and outer ends supported by the track;

a drive assembly housed within the body, the drive assembly comprising:

an energy source;

a motor coupled to the energy source; and a drive train drivingly coupling the motor to the belt so the belt moves along an endless loop path with the outer ends of the support arms supported by the track;

accessory supports removably secured to and hanging from the support arms, the accessory supports adapted to support at least one chosen accessory therefrom;

the accessory supports including a plurality of different types of accessory supports configured to support different types of accessories, the different types of accessory supports all including an inverted generally U-shaped hanger element configured to be removably secured to the support arms; and the different types of accessory supports including:

an accessory support having a U-shaped accessory hook;

an accessory support having a vertically extending planar support body with a least one open-top pocket supported by the planar support body; and an accessory support having a support body with an open ended, generally horizontally extending slot therein.

22. A method for storing different types of accessories using a motorized accessory holder comprising the following steps:

selecting a motorized accessory holder having a continuous loop belt from which support arms extend outwardly;

continuously supporting an outer end of said support arms by a support member;

selecting at least one type of accessory support configured to allow at least one type of accessory to be supported by said accessory support;

removably securing the at least one type of accessory support to the support arms;

supporting an accessory from the at least one type of accessory support removably secured to the support arms; and driving the belt thereby changing the positions of the support arms and said accessory therewith.

23. The storing method of claim 22 wherein the accessory holder selecting step includes the step of selecting a motorized accessory holder (a) having a body and (b) supporting the outer ends of support arms by a continuous loop track formed by body thereby effectively eliminating cantilever forces on the belt.

24. The storing method of claim 22 wherein the accessory support selecting step is carried out by selecting a plurality of different types of accessory supports configured to support a plurality of different types of accessories.

25. The storing method of claim 24 further comprising the step of choosing the numerical proportions of the different types of accessory supports according to the numbers of the different types of accessories.

26. The storing method of claim 22 wherein the accessory supports selecting step is carried out by selecting accessory supports configured to support a plurality of at least the following accessories: neckties, earrings, necklaces and belts.

27. A method for storing different types of accessories using a motorized accessory holder comprising the following steps:

selecting a motorized accessory holder (a) having a body, (b) having a continuous loop belt from which support arms extend outwardly, and (c) supporting the outer ends of support arms by a continuous loop track formed by body thereby effectively eliminating cantilever forces on the belt;

selecting a plurality of different types of accessory supports configured to support a plurality of different types of accessories;

choosing the numerical proportions of the different types of accessory supports according to the numbers of the different types of accessories;

removably securing the accessory supports to the support arms according to said numerical proportions;

supporting said different types of accessories from the plurality of different types of accessory supports removably secured to the support arms; and driving the belt thereby changing the positions of the support arms and said accessories therewith.

* * * * *